United States Patent [19]

Reinke et al.

[11] Patent Number: 4,476,824

[45] Date of Patent: Oct. 16, 1984

[54] MECHANICAL CONTROL ELEMENT HAVING WEAR-RESISTANT SURFACE

[76] Inventors: Friedhelm Reinke, Oelingrath 19, 5630 Remscheid; Friedhelm Emde, Jung-Stilling-Str. 6, 5609 Hückeswagen, both of Fed. Rep. of Germany

[21] Appl. No.: 318,801

[22] Filed: Nov. 6, 1981

[30] Foreign Application Priority Data

Nov. 26, 1980 [DE] Fed. Rep. of Germany ..... 3044477

[51] Int. Cl.[3] ..... F01L 1/18

[52] U.S. Cl. ..... 123/90.39; 29/156.7 R; 148/35

[58] Field of Search ..... 123/90.39, 90.51; 29/156.7 R; 148/35, 152

[56] References Cited

U.S. PATENT DOCUMENTS

| | | | |
|---|---|---|---|
| 2,901,386 | 8/1959 | Saives | 148/35 |
| 3,690,958 | 9/1972 | Thompson | 148/35 |
| 4,000,011 | 12/1976 | Sato et al. | 148/35 |
| 4,124,413 | 11/1978 | Komatsu et al. | 148/35 |
| 4,153,477 | 5/1979 | Beyer et al. | 148/35 |

FOREIGN PATENT DOCUMENTS

| | | | |
|---|---|---|---|
| 2747757 | 11/1978 | Fed. Rep. of Germany | 123/90.39 |

*Primary Examiner*—Craig R. Feinberg
*Assistant Examiner*—W. R. Wolfe
*Attorney, Agent, or Firm*—Cushman, Darby and Cushman

[57] ABSTRACT

Arrangement for providing an enhanced wear-resistant contact region for a cast iron mechanical control element such as a rocker arm. The control element is cast in a desired shape. It is then preheated to a temperature between room temperature and the Ms temperature of the iron element (Ms temperature is a function of the carbon content of the iron) to adjust the total hardness of the iron element. A surface region of a cast iron control element, intended for forming the contact region, is partially melted and then cooled to create a hard ledeburitic structure which has a mixed crystal structure and is at least partly martensitic and has a mixed hardness of at least 670 Hv.

9 Claims, 2 Drawing Figures

Fig. 1
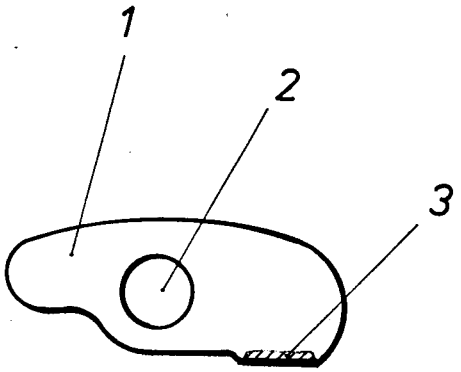
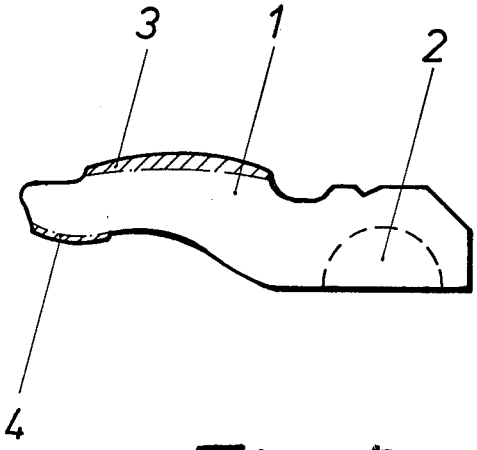
Fig. 2

MECHANICAL CONTROL ELEMENT HAVING WEAR-RESISTANT SURFACE

BACKGROUND OF THE INVENTION

This invention relates in general to mechanical control elements. More specifically, it relates elements of the type used in mechanical controls for internal combustion engines such as rocker arm assemblies.

Control elements such as in the form of rocker arms and the like have, in the past, been fabricated from inductively hardenable steel. These steel elements are hardened on a contact surface thereof inductively in order to make them more wear-resistant.

It has become advantageous to substitute cast iron for the hardenable steel fabrication material. It is known to produce iron elements cast in a desired shape. The elements are cast from iron with spheroidal graphite which are subjected to heat treatment with austenitic carbonitration, etc. Subsequently, these elements are cooled in such a manner that increased strength of material develops providing enhanced wear and durability. In order to improve the sliding properties of a control surface, the element may be phosphalated. However, the wear-resistance of cast iron elements is often not satisfactory for continuous or long-term operation of the element.

SUMMARY OF THE INVENTION

Therefore, the present invention provides a cast iron element having a more wear-resistant contact surface and a method for producing such an element. A cast iron control element is formed in a conventional manner. This element may be heat treated in a known manner to improve the strength of material. In order to further harden a contact surface and make it more wear-resistant, a surface layer of the element is melted. This melted surface layer is then subsequently cooled to form a fine-grained, essentially ledeburitic structure which has a mixed crystal, at least partly martensitic so as to develop a mixed hardness of at least 670 Hv.

Essentially, the present invention provides a mechanical control element comprising: an iron element cast in a desired shape; and a contact region formed on a portion of the surface of the cast iron element, the contact region being formed of a hard ledeburitic structure which has a mixed crystal and is at least partly martensitic and has a mixed hardness of at least 670 Hv.

The present invention also provides a method for enhancing the wear-resistance of a mechanical control element comprising the steps of: melting a surface layer of the control element; and subsequently cooling the control element to form a fine-grained, essentially ledeburitic structure which has a mixed crystal that is at least partly martensitic to develop a mixed hardness of at least 670 Hv.

Essentially, the present invention provides a mechanical control element formed by the process of: casting an iron element in a desired shape; melting a surface layer of the control element; and subsequently cooling the control element to form a fine-grained essentially ledeburitic structure which has a mixed crystal that is at least partly martensitic to develop a mixed hardness of at least 670 Hv.

BRIEF DESCRIPTION OF THE DRAWINGS

The invention will be further described with reference to the following drawings wherein:

FIG. 1 is a top view of a cast iron lever according to the present invention; and FIG. 2 is a second cast iron lever in accordance with the present invention.

DETAILED DESCRIPTION OF THE PREFERRED EMBODIMENT

Referring now to both FIGS. 1 and 2, there are shown two examples of control elements according to the present invention. In this case, the control element is a lever 1 fabricated from cast iron in a desired shape. Each lever includes a bore 2 running perpendicularly with respect to the plane of the drawings and disposed within lever 1 for receiving a rotational axle or the like. The levers include contact zones 3 and 4 formed in accordance with the present invention. As will be more fully described, these contact zones are formed by heat treating to form a ledeburitic structure with a partly martensitic mixed crystal.

The illustrated levers are components of a valve control for an internal combustion engine intended to be mounted rotatably around a rotational axle in bore 2. Of course, these levers are shown merely as non-limitative examples. The invention can be applied to any shape mechanical control element. In the cases of the illustrated examples, lever 1 is moved by way of contact zone 3 by a control can (not shown) around its rotational axle. The FIG. 2 embodiment may cooperate with a second lever arm (not shown) by way of contact zone 4 to ultimately operate a valve (not shown).

Contact zones 3 and 4 may be made more wear-resistant by treating them in the following manner. A surface region of the cast iron element is heated to a fusible state using an electric arc operated in a protective gas environment, such as for example argon. The surface is made fusible to a depth of at most 1.0 mm. After the surface layer has been made fusible by heating it, it is subjected to an automatic quenching. The quenching may be assisted by blasting onto the contact zone with cooling air or a liquid coolant. This process forms an essentially ledeburitic structure with a partly martensitic mixed crystal.

In addition to the treatment provided by the present invention, the hardness of the mixed crystal may be adjusted by suitable preheating of lever 1 up to about the Ms temperature. At the Ms temperature, martensite begins to form on a cooling alloy. For steel, the Ms temperature is that at which austenite begins changing to martensite on cooling This added step allows for influencing the natural state of stresses of the material and its melting depth.

While the invention has been described in connection with what is presently considered to be the most practical and preferred embodiments, it is to be understood that the invention is not to be limited to the disclosed embodiments but on the contrary, is intended to cover various modifications and equivalent arrangements including within the spirit and scope of the appended claims which scope is to be accorded the broadest interpretation so as to encompass all such modifications and equivalent structures.

What is claimed:

1. A mechanical control element formed by the following process:

casting an iron element in a desired shape;

preheating the iron element to a temperature up to about the Ms temperature of the iron element to adjust its total hardness;

partially melting a surface region of the control element; and subsequently cooling the partially melted surface region to form a fine-grained, essentially ledeburitic structure which has a mixed crystal structure that is at least partly martensitic and has a mixed hardness of at least 670 Hv.

2. A mechanical control element according to claim 1 wherein the step of partially melting is carried out to a degree that causes the formation of the ledeburitic-martensitic contact region having a maximum thickness of 1 mm.

3. A method for forming a mechanical control element comprising the following steps:

casting an iron element in a desired shape;

preheating the iron element to a temperature up to about the Ms temperature of the iron element to adjust its total hardness;

partially melting a surface region of the control element; and subsequently cooling the partially melted surface region to form a fine-grained, essentially ledeburitic structure which has a mixed crystal structure that is at least partly martensitic and has a mixed hardness of at least 670 Hv.

4. A method according to claim 3 wherein the step of partially melting is carried out to a degree that causes the formation of the ledeburitic-martensitic contact region to have a maximum thickness of 1 mm.

5. A control element for a control system of an engine, comprising:

a cast iron element having a contact region for sliding on the surface of a control cam and having a hard, wear-resistant structure with a mixed hardness of at least 670 Hv and a maximum layer thickness of substantially 1 mm, the control element being formed in part by heating it to a temperature up to about its Ms temperature to adjust the total hardness of the element and then providing the contact region with a ledeburitic-martensitic structure by partially melting the surface region and then cooling it.

6. A control element according to claim 5 wherein the contact region has a maximum thickness of 1 mm.

7. A control element according to claim 5 wherein the contact region is formed by partially melting a marginal zone of the cast iron element and subsequently cooling it.

8. A control element according to claim 5 wherein the cast iron element comprises a heat treated cast iron element.

9. A control element according to claim 8 wherein the cast iron element comprises an element that has been heated up to its Ms temperature and then cooled.

* * * * *